United States Patent [19]

Bank et al.

[11] Patent Number: 4,680,800

[45] Date of Patent: Jul. 14, 1987

[54] MOVING-COIL LOUDSPEAKER UNIT

[75] Inventors: Graham Bank; Stephen Scaife; Gareth Millward, all of Yorkshire, England

[73] Assignee: Wharfedale Loudspeaker Limited, Leeds, England

[21] Appl. No.: 726,368

[22] Filed: Apr. 23, 1985

[30] Foreign Application Priority Data

Apr. 24, 1984 [GB] United Kingdom ..... 8410417

[51] Int. Cl.[4] ..... H04R 9/04; H04R 9/06

[52] U.S. Cl. ..... 381/194; 381/197

[58] Field of Search ..... 179/115.5 VC, 115.5 R, 179/115.5 DV, 146 R, 178; 29/594; 381/194, 192, 197

[56] References Cited

U.S. PATENT DOCUMENTS 2,645,684 7/1953 Olson et al. ..... 179/115.5 R
4,132,872 1/1979 Inoue ..... 179/115.5 R

FOREIGN PATENT DOCUMENTS 54-72031 6/1979 Japan ..... 179/181 R
311071 5/1929 United Kingdom .
613287 11/1948 United Kingdom .
1162133 8/1969 United Kingdom .

*Primary Examiner*—Gene Z. Rubinson
*Assistant Examiner*—Danita R. Byrd
*Attorney, Agent, or Firm*—Fleit, Jacobson, Cohn & Price

[57] ABSTRACT

The moving coil loudspeaker drive-unit comprises a voice coil (4) wound on a former (3) and having fixed thereto a diaphragm (6) and a rear suspension spider (5). The drive unit of the invention comprises a component part build-ring (7) incorporated with the voice coil former (3) and adapted to interconnect the rear suspension spider (5) with the coil former (3) and to accurately locate it with respect to the voice coil (4). The build-ring (7) is also adapted to connect the diaphragm (6) to the coil former (3) together with the dust dome (8). The build-ring (7) also includes projections (9) to accommodate the electrical voice coil termination arrangements (10).

4 Claims, 3 Drawing Figures

MOVING-COIL LOUDSPEAKER UNIT

FIELD TO WHICH THE INVENTION PERTAINS

The present invention relates to moving coil loudspeakers and is more particulalry concerned with the provision of improved method of interconecting the component parts of the drive unit for such loudspeakers.

Moving coil loudspeaker drive units comprise a voice coil wound on a cylindrical former and having fixed thereto a conical section element and a rear suspension element. The cylindrical former is located in a radial magnetic field gap and the conical section element provides the main radiating element of the loudspeaker (i.e. the diaphragm). The front outer diameter of the diaphragm cone is terminated and suspended in a chassis or basket by a part circular curved section flexible surround. The rear suspension for the diaphragm cone is provided by a corrugated flexible element called a spider. The suspension elements form the centering mechanism for the coil; as well as a diaphragm restoring force in the case of the rear suspension element and a correct termination arrangement for bending waves in the diaphragm cone itself, as far as the outer suspension element is concerned. The accurate location of the moving coil in the radial gap magnetic field is of paramount importance for the performance of the loudspeaker drive unit.

PRIOR ART

In the prior art the component parts of the drive unit (coil former, diaphragm and rear suspension or spider) are attached to each other by the use of an adhesive band or bands, or by welding, and the position of the coil on the coil former, relative to the diaphragm and to the magnetic gap, is set by means of build jigs.

Problems which the Invention is to solve

This method of construction gives rise to a number of problems involving:

build up tolerances in the assembly,
variability in performance,
potential damage to components,
difficulties in handling the component parts,
thermal breakdown of the adhesive bonds,
unsuitability for automation and
disturbance of the assembly by the dust dome location.

The build up of tolerances arises during the construction of the loudspeaker drive unit because the component parts (coil former, diaphragm ad spider) have not only to be held in such a way that the coil former is in the centre of the magnetic gap, but also the assembled unit is the correct height, so that the voice coil on the coil former is at the correct height within the magnetic gap. The component parts are generally of soft material and any undue pressure or relaxation during construction of the drive unit will cause them to move relative to each other during the drying out of the adhesive. Further it has been found that two adhesive processes are required:

(a) diaphragm-to-coil former and
(b) diaphragm/coil former-to-spider.

It can be readily appreciated that in such a manufacturing process the component parts can easily be damaged during the various handling operations required for the two separate adhesive processes.

At high input power levels, in operation of the drive unit, the levels of heat generated from the voice coil can be sufficient to melt the adhesive between the diaphragm and or the suspension spider and the coil former.

The electrical connection to the voice coil, in the prior art assembly arrangements, are also generally adhesively bonded to either the diaphragm or the suspension spider. Such connections have to be made by hand after the assembly of the component parts of the drive unit and then bonded to the diaphragm or spider as required. This process does not readily lend itself to automation.

Further when the voice coil terminations are bonded to the diaphragm these termination arrangements interrupt the vibrational behaviour of the diaphragm.

It is an object of the present invention to provide a moving coil loudspeaker drive unit assembly which overcomes the above mentioned problems.

Means of Solving the Problems

According to the invention there is provided a moving coil loudspeaker drive unit comprising diaphragm, voice coil, voice coil former and rear suspension spider characterised in that the voice coil former incorporates a component part build-ring adapted to interconnect the rear suspension spider with the coil former and to accurately locate it with respect to the voice coil.

Further according to the invention the build-ring is adapted to connect the diaphragm to the coil former.

Also according to the invention the build-ring is adapted to accommodate a dust dome to envelope the open end of the coil former.

According to a further feature of the invention the build-ring incorporates projections adapted to accommodate electrical connection arrangements for the voice coil. The build-ring may also be a separate component or may be formed as part of the voice coil former which may be terminated at end by the build-ring. The build-ring may also incorporate robot arm cooperating projections.

BRIEF DESCRIPTION OF THE DRAWINGS

The invention will be more readily understood from the following description of one embodiment of the invention which should be read in conjunction with the accompanying drawings. Of the drawings FIG. 2 shows an enlarged cross-sectional view of parts of the drive unit of FIG. 1 while

DESCRIPTION OF THE PREFERRED EMBODIMENTS

Figure 1:
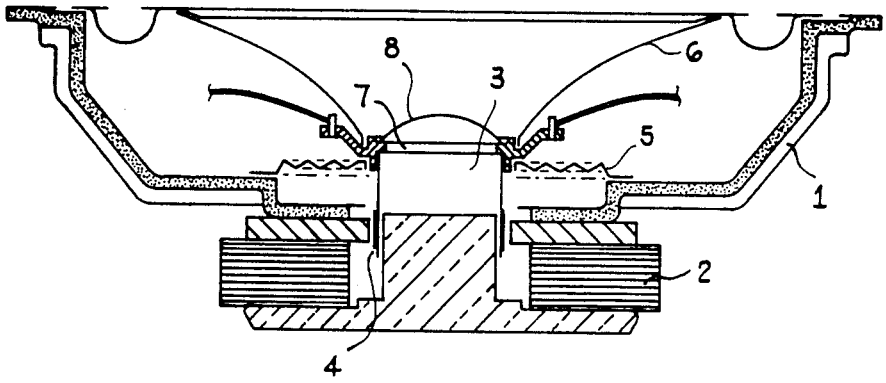
FIG. 1 shows, in cross-section a moving coil loudspeaker incorporating a drive unit according to the invention.

Considering firstly FIG. 1, the loudspeaker unit comprises a chassis or basket 1, a magnetic unit 2 and the moving coil drive unit. The drive unit consists of a number of component parts involving a coil former 3 carrying the voice coil 4, a rear suspension spider 5, the loudspeaker diaphragm 6 and a dust dome 8. The coil former 3 is terminated at its end remote from the voice coil 4 by a build-ring 7. The build-ring is used to provide an interconnection arrangement for the mechanical component parts of the drive unit. The rigid build-ring 7 is made from an electrically insulating material.

The build-ring 7 provides the solution to the problems outlined in the introduction as it is interposed between the three major components (coil former 3, diaphragm 6 and spider 5) of the drive unit without them necessarily being in direct contact with each other.

Figure 2:
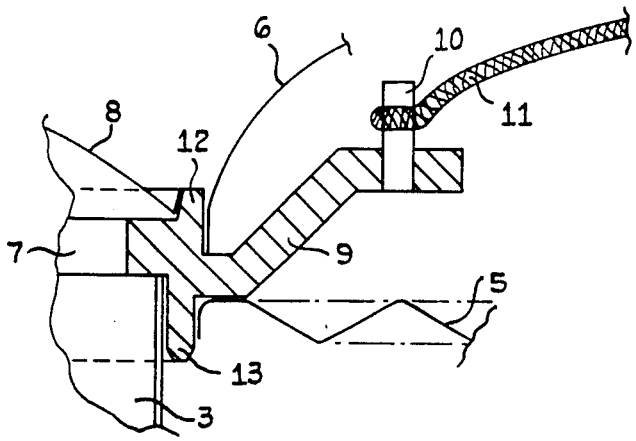
Figure 3:
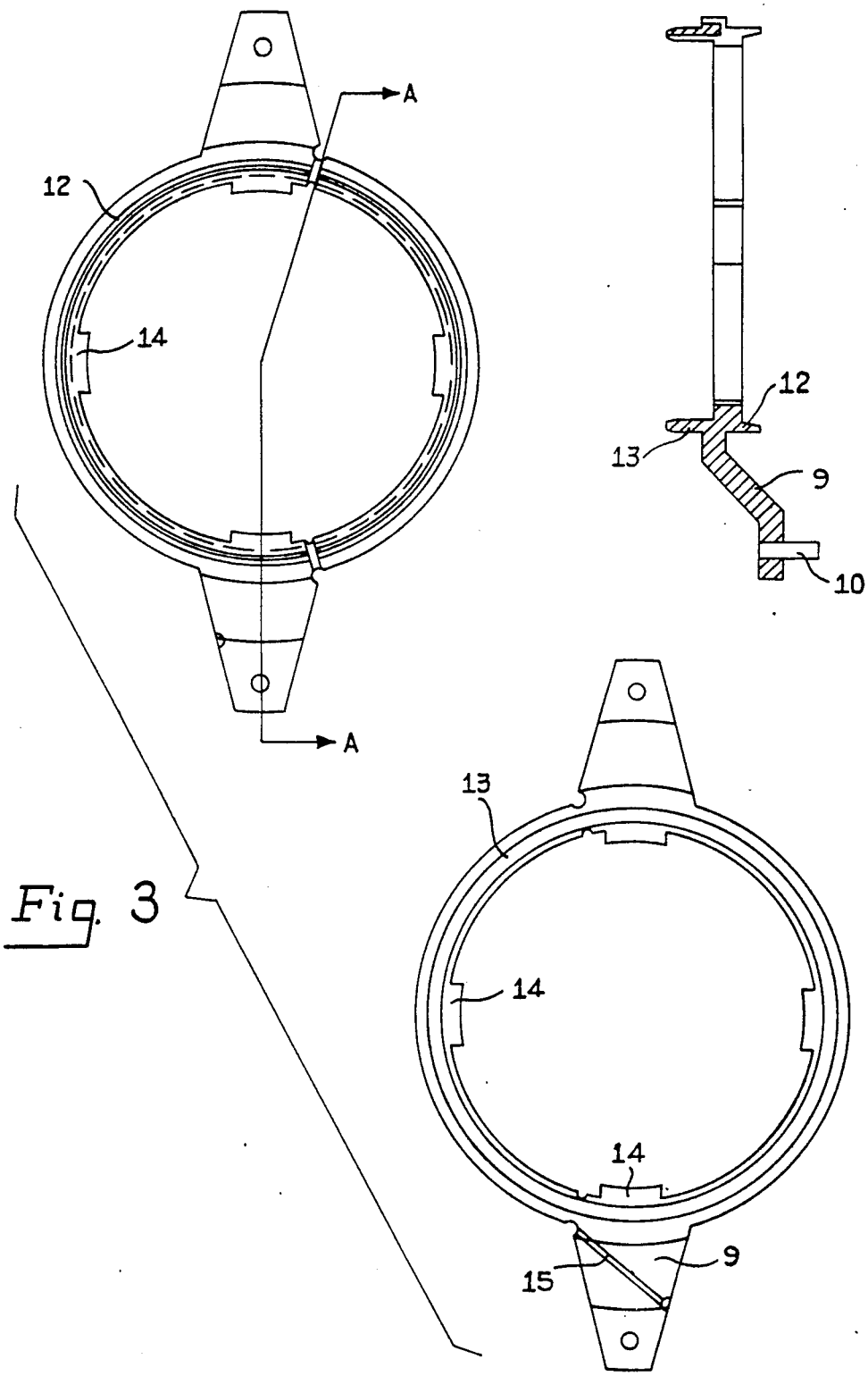
FIG. 3 shows, in enlarged form, the details of a separate build-ring for use in the embodiment of the invention.

The construction of the build-ring 7 can be more readily appreciated from FIGS. 2 and 3. It can be seen that the build-ring 7 has an upper component locating ring 12 and a lower component locating ring 13. Also incorporated into the build-ring are projections, such as 9, carrying an electrical connector pin 10 to which flying leads, such as 11, and the coil ends are electrically connected.

The build-ring 7 is of particular advantage when manufacturing the loudspeaker drive unit as it allows a stepby-step process of assembly to be achieved. To construct the drive unit, the coil former 3 is placed inside the lower retaining ring 13 and attached by a suitable adhesive. The apertured apex of the diaphragm cone is placed outside the upper retaining ring 12 and attached by adhesive bonding. The suspension spider 5 is then attached to the outside of the lower retaining ring 13 and adhesively bonded thereto. Finally the dust dome 8 is bonded to the inside of the upper retaining ring 12, inside the cone apex aperture.

The build ring also includes a number of internal projections such as 14. These projections are used to cooperate with an assembly head attached to a machine or robot arm for use in an automated assembly process.

As mentioned previously, the build-ring 7 incorporates electrical connection carrying arms such as 9. The arms 9 may be adapted to accommodate the voice coil wires in channels such as 15. The voice coil wires and flying or flexible lead-out wires 11 are connected to the conducting terminal 10 accommodated in each arm 9. With this arrangement, no mass or bending moment is applied to the diaphragm and the arms move the connection point away from the diaphragm apex where there is insufficient space to confidently connect the flexible leads to the voice coil wires. The projection or arms 9 are provided in a "balanced" manner however they need not all carry terminals and further arms may be introduced to accommodate multiple voice coil connection requirements.

The build-ring 7 is made from a material which has a high melting point and is suitable for use with high melting point adhesives. This has particular advantage in high energy coil loudspeakers, where the heat generated in conventional loudspeaker construction may lead to relative movement of the coil former and diaphragm and/or suspension spider. The rigidity of the build-ring retains the diaphragm/coil former/suspension spider positions at higher temperatures than is the case of simple inter-bonding.

It can be seen that, if the dimensions of the buildring are suitably chosen, the position of the voice coil and the suspension spider relative to the diaphragm and to each other can be guaranteed accurately to within tolerances of manufacture of the individual parts, which are much smaller than those of conventional methods. Furthermore, since the coil former and suspension spider are supported by a rigid ring, they are less susceptible to damage during drive unit and loudspeaker assembly processes.

Suitable materials for the build-ring are glass fibre reinforced plastics, such as polycarbonate, nylon or polypropylene, with or without a metal reinforcing ring as well as unreinforced versions of the same plastics, or higher temperature plastics such as polymide. The choice of material for the build-ring depends on those used for the diaphragm, coil former and suspension spider and should take thermal expansion into account.

The component parts ofthe drive unit may be, as defined above, adhesively bonded to the build-ring, however, the upper and lower support rings may be apertured to allow sprung or interference co-operation between the various component parts and the build-ring so that adhesive bonding is not required. Other alternative arrangements will be readily seen by people skilled in the art and it is intended that such alternatives are incorporated within the scope of the invention as defined by the claims. For example the build-ring may be integrally formed with the coil former or may be located on the coil former at any suitable position other than at the end of the former.

Technical Advantages of the Invention

The build-ring is used to provide an interconnection arrangement for the mechnical component parts of the drive unit. The build-up provides for the accurate location of the component parts of the drive unit and supports these component parts during the drive unit assembly process.

What we claim is:

1. A moving coil loudspeaker drive unit comprising a diaphragm, a voice coil, a voice coil former and rear suspension spider, the improvement comprising an electrically insulating build-ring adapted to cooperate with one end of the voice coil former and to interconnect the rear suspension spider with the coil former and to accurately locate said spider with respect to the voice coil, and at least one radially extending projection on said build-ring incorporating at least one electrical terminal electrically connected to the voice coil.

2. A moving coil loudspeaker drive unit according to claim 1 in which the build-ring is adapted to interconnect the diaphragm with the coil former.

3. A moving coil loudspeaker drive unit according to claim 1 in which the build-ring incorporates a plurality of internally extending projections adapted for use with mechanical handling equipment.

4. A moving coil loudspeaker drive unit according to claim 1 in which a plurality of projections are provided one for each voice coil termination required.

* * * * *